United States Patent [19]

Goodridge et al.

[11] Patent Number: 4,557,812

[45] Date of Patent: Dec. 10, 1985

[54] PURIFYING MIXED-CATION ELECTROLYTE

[75] Inventors: Francis Goodridge, Ponteland; Raymond E. Plimley, Jesmond; Allen R. Wright, Gateshead, all of England

[73] Assignee: National Research Development Corporation, London, England

[21] Appl. No.: 635,579

[22] Filed: Jul. 30, 1984

[30] Foreign Application Priority Data

Aug. 10, 1983 [GB] United Kingdom ..... 8321556
Sep. 20, 1983 [GB] United Kingdom ..... 8325169

[51] Int. Cl.[4] ..... C25F 5/00

[52] U.S. Cl. ..... 204/130; 204/106; 204/108; 204/222

[58] Field of Search ..... 204/130, 222, 114, 116–119, 204/112–113, 106–108

[56] References Cited

U.S. PATENT DOCUMENTS

| | | | |
|---|---|---|---|
| Re. 28,379 | 3/1975 | Backhurst et al. | 204/20 |
| 556,092 | 3/1896 | Frölich | 204/111 |
| 3,941,669 | 3/1976 | Bharucha et al. | 204/222 |
| 3,974,049 | 8/1976 | James et al. | 204/222 |
| 4,073,702 | 2/1978 | Fleischman et al. | 204/222 |
| 4,202,752 | 5/1980 | Sherwood et al. | 204/222 |
| 4,212,722 | 7/1980 | Avedesian et al. | 204/222 |
| 4,272,333 | 6/1981 | Scott et al. | 204/222 |

OTHER PUBLICATIONS

"The EMF Series", The Galvanic Series, Hanson Van Winkle-Nunning Co., 1949.

*Primary Examiner*—R. L. Andrews
*Attorney, Agent, or Firm*—Murray, Whisenhunt & Ferguson

[57] ABSTRACT

An electrolyte containing 65 g/l zinc and 150 g/l Cu is purified in zinc, that is, the copper is removed, by causing the electrolyte to fluidize a bed 8 of ½ mm copper particles. The bed is fluidized by 25% to make it 42 cm deep. An anode 11 is disposed above the top of the bed. A cathode 9 is disposed part-way up the bed. Copper is electroplated onto the bed particles. Any zinc which may be electroplated onto the bed particles tends to redissolve with concomitant cementation, on the particles, of copper, which can be recovered. The electrolyte is thus eventually completely stripped of copper and can be used for zinc electrowinning.

16 Claims, 1 Drawing Figure

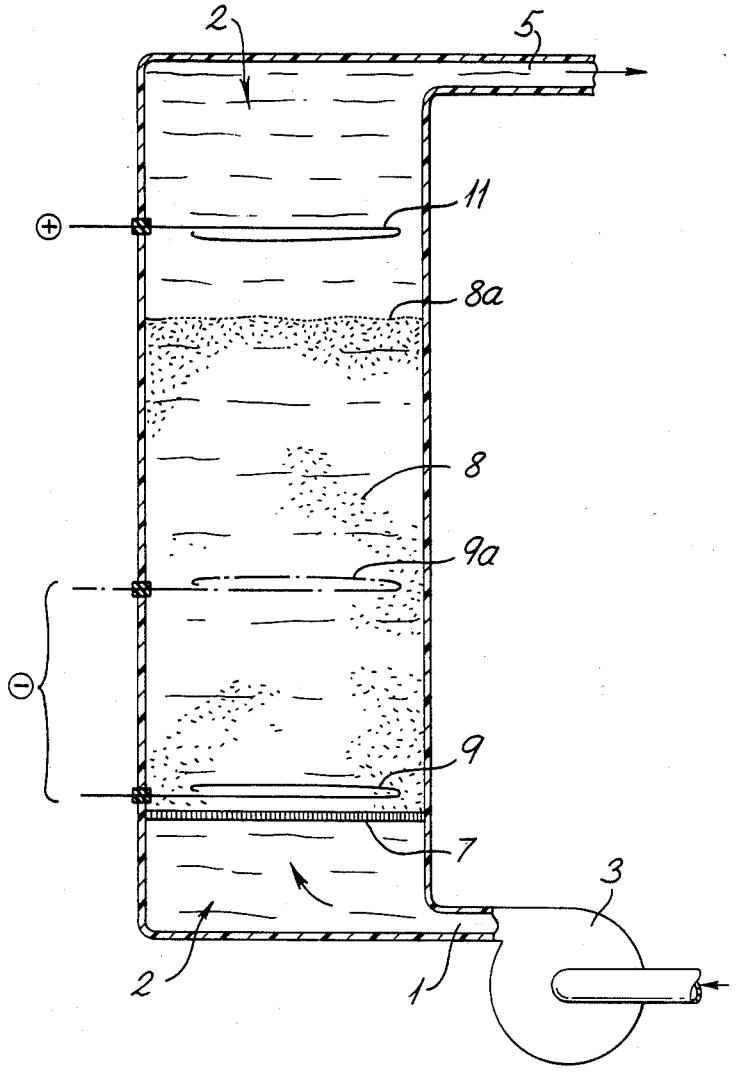
2
5
11
8a
8
9a
9
7
3
2
1

PURIFYING MIXED-CATION ELECTROLYTE

This invention relates to a method of purifying a mixed-cation electrolyte, and to apparatus for performing the method. An example of a mixed-cation electrolyte is a nickel electrolyte contaminated with copper, and another example is a feed liquor for zinc electrodeposition, containing as contaminants copper and possibly cobalt and cadmium.

Before zinc is recovered electrochemically, a feed liquor is required where the concentration of copper (and any other cations which would be deposited at an electrode potential lower than that for zinc) has been reduced to less than 1 mg/l (1 part per million).

At present this is done by throwing zinc metal—the very product which is being sought—in the form of finely divided powder into the feed liquor, to precipitate out ('cement') the said cations such as copper. This is severely disadvantageous for several reasons. For example, production and storage of the zinc powder are expensive, the process is performed not at room temperature but at 75° C., plant for this stage adds to the capital cost, the consequent liquid/powder separations are cumbersome, and the process is conventionally controlled by adding expensive $Sb_2O_3$.

The present invention is a method of purifying and electrolyte containing cations of a less noble metal from contamination by cations of a more noble metal, comprising upwardly fluidising a bed of (at least superficially) electronically conductive particles with the electrolyte, the particles being more noble than said less noble metal, a cathode current feeder being provided in contact with the bed, an anode being provided either (i) in the fluidising electrolyte but at a height above the bed of particles when fluidised or (ii) in contact with the bed but being of a material having a contact resistance in air between itself and a copper test surface of at least 10 times the contact resistance under the same conditions of measurement between the copper test surface and another surface of copper, and applying a voltage between the cathode current feeder and the anode, whereby the cations tend to be electroplated on the particles of the bed but the less noble metal (if electroplated) tends to redissolve with concomitant cementation, on the particles, of the more noble metal, and removing the electrolyte which has passed through the bed and in which the concentration of the nobler-metal cations has thereby been reduced, or optionally recycling the (or part of the) electrolyte to the bed one or more times before removing it (or part of it).

It will be appreciated that 'purification' in this specification thus means removal of the cations of the *more* noble metal, this metal being regarded as the impurity. If the 'impurity' is of value (perhaps even of more value than the metal being 'purified'), it can be recovered from the bed, for example by removal (on an occasional or continuous basis) of the bed particles which have grown largest, or by exploiting the feature (which sometimes occurs) that the impurity deposit may be only loosely bound to the bed particles and hence tends to be knocked off in the normal jostling motion of the particles; the impurity may thus be recovered, as it becomes detached from the particles and entrained in electrolyte, by filtration of electrolyte which has been through the bed. In such a case, the bed particles could be of a different metal (e.g. cobalt) from the expected impurity (e.g. copper). Where the electrolyte contains cations of three or more metals, the more noble metal(s) behave as 'impurities' in the method, and the less noble metal(s) are 'purified'. The electrolyte in such a case is generally depleted in the order: most noble first. This order may however by blurred depending on the closeness of the deposition electrode potentials (which are dependent on the nature of the respective ionic species, its concentration and its temperature). Ultimately, after a sufficient number of recirculations of the electrolyte and/or with the passage of sufficient current, all cations noble enough to deposit on the bed particles will be removed from the electrolyte and, taking the example of a zinc electrolyte, all those cations will be removed which would otherwise have intefered with the electrodeposition of the zinc.

Preferably the bed is fluidised to an expansion of up to 70% (e.g. 5 to 50%) of its static (i.e. unfluidised) height, more preferably 15 to 30%.

Preferably the applied voltage (in volts) divided by the distance (in cm) between the cathode current feeder and the top of the bed when fluidised in from 1 to 10.

Preferably the current through the bed is from 300 A to 3000 A per square meter (in plan view) of the bed.

Preferably the electrolyte to be purified contains zinc, copper and optionally cadmium and/or cobalt ions.

Preferably the bed particles are of copper. They are preferably from 0.1 to 1.0 mm in diameter, more preferably from 0.4 to 0.8 mm.

Preferably the bed rests on a distributor for producing a substantially uniform upwards fluidising flow.

The cathode current feeder may be at or near the base of the bed, or may be disposed part-way up, e.g. at least one-fifth of the way up the (fluidised) bed, whereby (assuming option (i) for the anode), the uppermost four-fifths (at most) of the bed is electrochemically active while the whole of the bed is active as regards the redissolution/cementation aspect. Preferably the cathode current feeder is at least one-quarter, more preferably at least one-third, e.g. at least one-half, of the way up.

The cathode current feeder may be very near the top of the fluidised bed, e.g. up to as near as 10 particle diameters down from the top of the fluidised bed, preferably 10–100 particle diameters down, another preferred range being 20–200 particle diameters down. For example, the cathode current feeder may be disposed 30 particle diameters below the top of the fluidised bed with the bed operating at an expansion of 20%.

If it appears that the redissolution/cementation aspect of the bed operates more effectively at a different expansion from the most effective expansion for electrodeposition, the bed may be run with differential expansions. Thus, for example, the lower part of the bed may be a narrow column, widening out upwardly in the region of the cathode current feeder, whereby, at a given electrolyte throughput, the lower (redissolution/cementation) part is at a greater expansion than the upper part (electrodeposition, but of course also with the redissolution/cementation occurring alongside); alternatively, the lower part could be less expanded then the upper part.

The present invention extends to the thus-purified electrolyte and to the thus-grown bed particles.

BRIEF DESCRIPTION OF THE DRAWINGS

The invention will now be described by way of example with reference to the accompanying drawing, which shows schematically apparatus according to the invention, for performing the method according to the invention.

DETAILED DESCRIPTION OF THE INVENTION

A cylindrical column of non-conductive material is about 5 cm in diameter (20 $cm^2$ area in plan view) and somewhat over 0.5 m tall. It has a liquid inlet 1 at the base, fed by an adjustable pump 3, and a liquid outlet 5 at the top. Near the base, a flow distributor 7 (such as a sieve or frit) is provided and, resting on it if it is non-conductive, or slightly above it, as a cathode current feeder 9, which is a copper wire bent into one turn of coil. Resting on the distributor 7 is a bed 8 of fairly uniform copper particles. As alternative position for the current feeder 9 is shown at 9*a*, part-way up the bed.

An anode 11 is provided 48 cm above the distributor 7 and consists of a platinum wire bent into one turn of coil. Alternatively, the anode 11 may be a platinum gauze within an open-ended glass tube provided to minimise the amount of oxygen (evolved at the gauze) which dissolves in the electrolyte, whereby to restrict oxidation (and hence passivation) of the copper particles.

In use, the whole apparatus is filled with an electrolyte 2 from a supply feeding th pump 3, the electrolyte being an aqueous solution of a mixture of zinc and copper sulphates (65 g/l of zinc, i.e. 1M, and about 150 mg/l of copper). The pump 3 is adjusted to a flow rate which fluidises the bed 8 by 25%, i.e. to a height of 42 cm above the distributor 7. The top edge 8*a* of the bed remains very well defined, and, though it undulates, never touches the anode 11. (In other runs, the bed 8 was fluidised to an expansion of 17% and of 22%. In later runs, it was fluidised to 30%.)

EXPERIMENTS 1 and 2

In these Experiments 1 and 2, the bed 8 is 34 cm deep while at rest and consists of copper particles in the size range 0.5 to 0.7 mm diameter.

Two experiments were performed, each on a continuously recirculated batch of 10 liters of the electrolyte. In Experiment 1, the cathode feeder 9 was mounted 10 cm above the distributor 7, that is 32 cm below the top edge 8*a* of the fluidised bed 8. With the anode/cathode voltage set at a nominal 60 V, measurements were taken every 30 minutes and the following results were obtained:

| Time | Current | Voltage | Temperature | Electrolyte copper concentration |
|---|---|---|---|---|
| 0 minutes | 1.90A | 61.2 V | 37° C. | 184 mg/l |
| 30 minutes | 2.70A | 60.7 V | 40° C. | 66 mg/l |
| 60 minutes | 2.30A | 54.5 V | 41½° C. | 3.0 mg/l |
| 90 minutes | 2.06A | 54.5 V | 43° C. | 1.6 mg/l |

Current efficiency for copper removal in the first half-hour was calculated as 84%, in the last half-hour as 1.1%, and over the first hour as 61.7%.

In Experiment 2, the cathode feeder 9 was mounted 30 cm above the distributor 7, that is 12 cm below the top edge 8*a* of the fluidised bed 8. The electrolyte had a somewhat lower starting concentration of cupric ion (as will be seen from the results). With the anode/cathode voltage set at a nominal 55 V, measurements were taken every 20 minutes and the following results were obtained:

| Time | Current | Voltage | Temperature | Electrolyte copper concentration |
|---|---|---|---|---|
| 0 minutes | 1.60A | 56.5 V | 28° C. | 146 mg/l |
| 20 minutes | 1.95A | 55.0 V | 31° C. | 97.2 mg/l |
| 40 minutes | 2.11A | 54.8 V | 34° C. | 43.0 mg/l |
| 60 minutes | 2.35A | 53.8 V | 36° C. | 6.4 mg/l |
| 80 minutes | 2.48A | 52.8 V | 38½° C. | 1.4 mg/l |

Current efficiency for copper removal in the first twenty-minute period was calculated as 67.8%, in the last twenty-minute period as 5.1% and over the first hour as 56.8%.

EXPERIMENTS 3 to 5

In these Experiments 3 to 5 the copper particles are in the size range 0.47 to 0.60 mm diameter. The electrolyte temperature was held at 40° C. The anode 11 was positioned 5 cm above the top of the fluidised bed after the chosen expansion on fluidisation had been established in each experiment. In these Experiments, the current was controlled to 2 A by periodically adjusting the voltage. Copper concentration was plotted against coulombs passed, and the current efficiency calculated for removal of each successive decrement of 20 mg/l of copper. These efficiencies are thus directly comparable throughout Experiments 3–5.

Experiment 3 compares two fluidised beds containing different numbers of identical particles, both fluidised to an expansion of 25%, and with the cathode feeder 9 set 5 cm above the distributor 7:

| Fluidised bed depth (cm) Copper concentration decrement (mg/l) | 27 Decremental current efficiency (%) | 44 Decremental current efficiency (%) |
|---|---|---|
| 100–80 | 43.4 | 40.5 |
| 80–60 | 37.7 | 35.7 |
| 60–40 | 27.6 | 28.2 |
| 40–20 | 19.6 | 14.6 |
| 20–0 | 11.5 | 8.7 |
| Average voltage | 24.8 V | 37.1 V |

Experiment 3 demonstrates that there is little change in the current efficiency of the bed on increasing the number of particles present, although there is a considerable reduction in power efficiency, as the increased cathode feeder-anode distance results in a larger voltage requirement.

Experiment 4 therefore compares different anode-cathode distances all in the deeper bed of Experiment 3. The anode 11 was (as always) 5 cm above the top of the fluidised bed, itself 44 cm deep (under a fluidisation expansion of 25%); in the table an anode-to-cathode spacing of (e.g.) 34 cm means that the cathode finder 9 was set $(44+5-34)=15$ cm above the distributor 7. The results were:

| Anode-to-cathode distance (cm) | 44* | 34 | 24 | 14 |
|---|---|---|---|---|
| Copper concentration decrement (mg/l) | Decremental current efficiency (%) | Decremental current efficiency (%) | Decremental current efficiency (%) | Decremental current efficiency (%) |
| 60–40 | 28.2 | 28.9 | 31.1 | 39.2 |
| 40–20 | 14.6 | 22.9 | 21.3 | 32.8 |
| 20–0 | 8.7 | 10.0 | 12.3 | 19.0 |
| Average voltage | 37.1 V | 32.8 V | 29.0 V | 27.9 V |

*Repeats Experiment 3 (44 cm bed)

Reducing the anode-to-cathode distance thus produces an improvement in the current efficiency even over that obtained in the 27 cm bed (Experiment 3) at a comparable cathode feeder-anode distance.

Experiment 5 compares different expansions of the same static bed, in fact, the bed of Experiment 4, which is 35 cm deep when static, 44 cm when fluidised to an expansion of 25% and 46 cm when fluidised to an expansion of 30%. The results were:

| Bed expansion | 25%* | 30% |
|---|---|---|
| Anode-to-cathode distance | 14 cm | 16 cm |
| Copper concentration decrement (mg/l) | Decremental current efficiency (%) | Decremental current efficiency (%) |
| 60–40 | 39.2 | 48.6 |
| 40–20 | 32.8 | 33.7 |
| 20–0 | 19.0 | 24.8 |
| Average voltage | 27.9 V | 28.5 V |

*Repeats Experiment 4 (14 cm anode-to-cathode-distance)

The overall current efficiencies over the range 60–0 mg/l copper can be summarised thus:

| Experiment | Fluidised bed depth (cm) | Bed expansion (%) | Cathode feeder height above distributor (cm) | Overall current efficiency (%) |
|---|---|---|---|---|
| 3 | 27 | 25 | 5 | 17.2 |
| 3, 4 | 44 | 25 | 5 | 14.9 |
| 4 | 44 | 25 | 15 | 16.8 |
| 4 | 44 | 25 | 25 | 18.7 |
| 4, 5 | 44 | 25 | 35 | 27.6 |
| 5 | 44 | 30 | 35 | 30.6 |

EXPERIMENTS 6 to 8

In Experiments 6 to 8, the copper particles are in the size range 0.47 to 0.60 mm diameter, the electrolyte temperature was held at 40° C., the anode 11 was positioned 5 cm above the top of the fluidised bed, and the current is held as 2 A, all as in Experiments 3 to 5. By "0 mg/l Cu" is meant the limit of detection, in our case about 1 mg/l.

Experiment 6 investigates the effect of changing the bed height, with the cathode feeder 9 set 5 cm below the top of the fluidised bed in each case:

| Fluidised bed depth | 31 cm | 25 cm |
|---|---|---|
| (Depth when static) | 25 cm | 20 cm |
| Time from 100 mg/l Cu to O mg/l Cu | 94.5 mins | 118.7 mins |
| Current efficiency over decrement 10–0 mg/l Cu | 17.4% | 10.9% |

Thus with the electrolytic part of the bed kept identical, increasing the non-electrolytic part improved the performance.

Experiment 7 compares different expansions of the same (static 36 cm) bed. With the cathode feeder 9 placed 5 cm above the bottom of the bed, the results were:

| Expansion | 30% | 20% |
|---|---|---|
| Fluidised bed depth | 47 cm | 43 cm |
| Time from 70 mg/l Cu to O mg/l Cu | 74.4 mins | 125.7 mins |
| Current efficiency over decrement 10–0 mg/l Cu | 11.55% | 4.4% |

In Experiment 8, a current of 2 A is compared with higher currents, all in a 36 cm (when static) bed expanded by 30% to 47 cm, with the cathode feeder 9 at 5 cm from the top of the bed (42 cm above the distributor 7).

| Current | 2A | 3A | 5A |
|---|---|---|---|
| Current density | 1000 A/m$^2$ | 1500 A/m$^2$ | 2500 A/m$^2$ |
| Time from 100 mg/l Cu to 10 mg/l Cu | 50.3 mins | 70.9 mins | 61.2 mins |
| Time from 10 mg/l Cu to 0 mg/l Cu | 18.5 mins | infinite | infinite |
| Current efficiency over decrement 20–10 mg/l Cu | 21.2% | 10.9% | 5.8% |

At high currents, the copper concentration fell asymptotically towards a limit of above 1 mg/l Cu, which could be unacceptable for some purposes.

The following remarks are now for technical interest and are not binding, since the method described herein is of practical use regardless of its theoretical basis.

The net effect of the process as exemplified in these Experiments is preferential copper deposition. We believe (while not wishing to be bound by this suggestion) that the actual mechanism is more complicated. Thus, we postulate that fluidised bed electrodes even in their monopolar form contain bipolar aggregates, the statistical size and diration of which will depend (among other factors) on the bed expansion. In consequence, copper will be deposited preferentially to zinc at the cathodic surfaces of the bipolar aggregates and zinc will dissolve preferentially to copper at their anodic surfaces. The net result is the selective stripping of copper impurities. This mechanism is supported by the property of fluidised bed electrodes that copper deposited from a commercial copper-winning solution is purer than that deposited from the same solution onto a plane electrode. In any part of the fluidised bed below the cathode current feeder (i.e. outside the anode/cathode electric field), the possibility of bipolar aggregates ceases to apply, and any deposited zinc on any particle will tend to dissolve in favour of depositing copper.

Experiments 3 to 8 indicate that the improvements in current efficiencies are mainly due to an increase in the cementation rate. We think this because upon simultaneously increasing the volume of the bed in which the cementation may occur (decreasing cathode feeder-anode distance) and increasing mass transfer in the bed (increased expansion), improved copper removal (=deposition) rates and efficiencies were obtained, whilst increasing the volume of the electrolytic region of the bed did not affect the copper removal rate.

We claim:

1. A method of purifying an electrolyte containing cations of a less noble metal from contamination by cations of a more noble metal, said method comprising:

upwardly fluidizing a bed of at least superficially electronically conductive particles with the electrolyte to provide a fluidized bed, said particles being more noble than said less noble metal, a cathode current feeder being provided in contact with said bed and being disposed at least one-half the way up said fluidized bed, an anode being provided in said electrolyte at a height above said fluidized bed, said anode being spaced from said cathode current feeder in the direction of fluidization of said bed;

applying a voltage between said cathode current feeder and said anode to cause said cations to be electroplated on said particles of said bed, the less noble metal upon being electroplated redissolving with concomitant cementation of the more noble metal on the particles;

removing the electrolyte which has passed through the bed and in which the concentration of the nobler-metal cations has been reduced.

2. A method according to claim 1, wherein at least part of the electrolyte is recycled to the bed at least once before it is removed.

3. A method according to claim 1, wherein the more noble metal is recovered from the bed.

4. A method according to claim 1, wherein the bed is fluidised to an expansion of up to 70% of its static height.

5. A method according to claim 4, wherein the bed is fluidised to an expansion of 5 to 50% of its static height.

6. A method according to claim 5, wherein the bed is fluidised to an expansion of 15 to 30% of its static height.

7. A method according to claim 1, wherein the applied voltage (in volts) divided by the distance (in cm) between the cathode current feeder and the top of the bed when fluidised is from 1 to 10.

8. A method according to claim 1, wherein current through the bed is from 300 A to 3000 A per square meter of the bed.

9. A method according to claim 1, wherein the bed particles are of copper.

10. A method according to claim 1, wherein the bed particles are from 0.1 to 1 mm in diameter.

11. A method according to claim 1, wherein the cathode current feeder is from 10 to 100 particle diameters down from the top of the fluidised bed.

12. A method according to claim 1, wherein the cathode current feeder is from 20 to 200 particle diameters down from the top of the fluidised bed.

13. A method according to claim 1, wherein the electrolyte to be purified contains zinc ions and copper ions.

14. A method according to claim 13, wherein the electrolyte further contains cadmium ions.

15. A method according to claim 13, wherein the electrolyte further contains cobalt ions.

16. A method of purifying an electrolyte containing cations of a less noble metal from contamination by cations of a more noble metal, said method comprising:

upwardly fluidizing a bed of at least superficially electronically conductive particles with the electrolyte to provide a fluidized bed, the particles being more noble than said less noble metal, a cathode current feeder being provided in contact with said bed, said cathode current feeder being at least one-half of the way up said fluidized bed, an anode being provided in contact with said bed but being of a material having a contact resistance in air between itself and a copper test surface of at least ten times the contact resistance under the same conditions of measurement between the copper test surface and another surface of copper, said anode being spaced from said cathode current feeder in the direction of fluidization of said bed;

applying a voltage between said cathode current feeder and said anode, to cause said cations to be electroplated on said particles of said bed, said less noble metal upon being electroplated re-dissolving with concomitant cementation of the more noble metal on the particles;

removing the electrolyte which has passed through the bed and in which the concentration of the nobler-metal cations, has been reduced.

* * * * *